US007448726B2

(12) United States Patent
Harper et al.

(10) Patent No.: US 7,448,726 B2
(45) Date of Patent: Nov. 11, 2008

(54) WIPING

(75) Inventors: Kit L Harper, Vancouver, WA (US); Michael L Hilton, Vancouver, WA (US); Andrew T. Davis, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 406 days.

(21) Appl. No.: 11/252,691

(22) Filed: Oct. 18, 2005

(65) Prior Publication Data

US 2007/0085876 A1 Apr. 19, 2007

(51) Int. Cl.
*B41J 2/165* (2006.01)

(52) U.S. Cl. ..... 347/33; 347/29; 347/32

(58) Field of Classification Search ..... 347/33, 347/29, 32

See application file for complete search history.

(56) References Cited

U.S. PATENT DOCUMENTS

| | | | | |
|---|---|---|---|---|
| 5,886,714 | A | 3/1999 | Burney | |
| 5,953,025 | A * | 9/1999 | Sakurai | 347/33 |
| 6,231,157 | B1 * | 5/2001 | Saijo | 347/33 |
| 6,244,685 | B1 | 6/2001 | Yamada | |
| 6,585,350 | B2 | 7/2003 | Barinaga | |
| 6,585,351 | B2 * | 7/2003 | Nakagawa et al. | 347/33 |
| 6,663,215 | B2 | 12/2003 | Klausbruckner | |
| 6,959,978 | B2 * | 11/2005 | Chang | 347/33 |

* cited by examiner

*Primary Examiner*—shih-wen hsieh

(57) ABSTRACT

Example embodiments of wiping are shown and described in which a print head is wiped along a non-linear path.

19 Claims, 4 Drawing Sheets

WIPING

BACKGROUND

Printheads are used to deposit ink upon media. Printheads are sometimes wiped to maintain the printheads. Some conventional techniques for wiping printheads may be inadequate in some applications.

DETAILED DESCRIPTION

Figure 1:
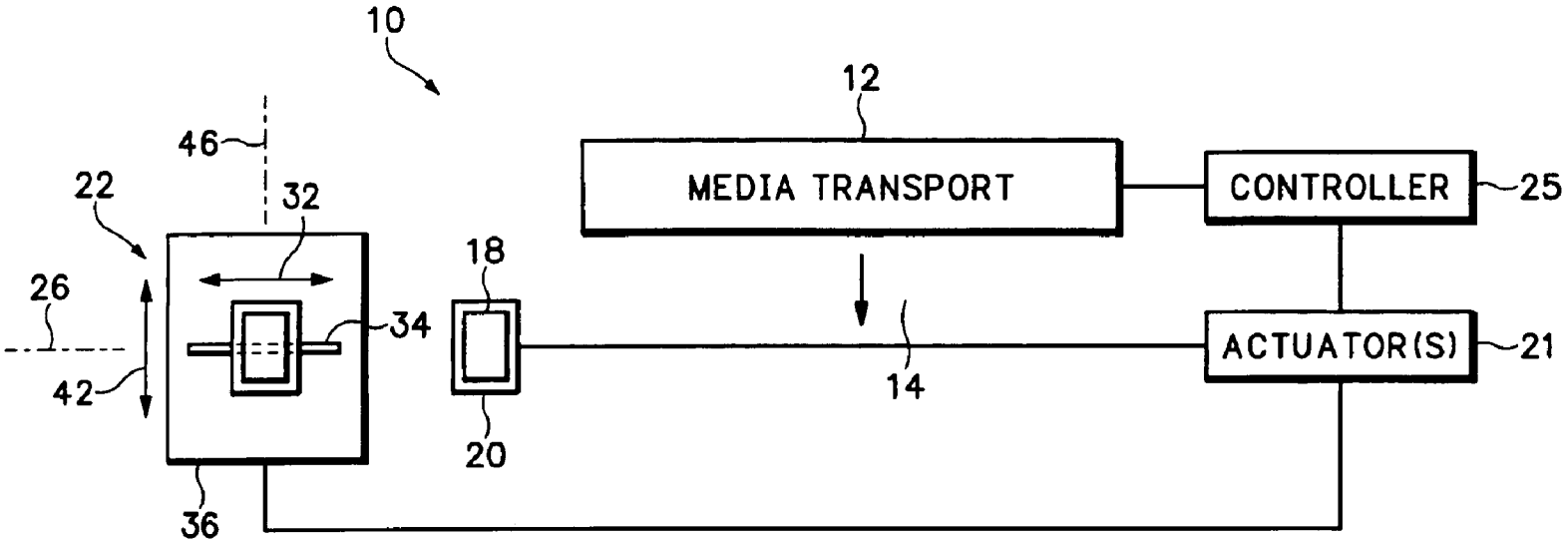
FIG. 1 illustrates an example printing system according to an example embodiment.

FIG. 1 schematically illustrates a printing system 10 according to an example embodiment. The printing system 10 may comprise, in some embodiments, an inkjet printer.

As illustrated, the printing system 10 generally includes a media transport 12 for advancing a medium (not shown) through a print zone 14. The media transport 12 may comprise one or more of a drum, rollers, belts, or other suitable devices for advancing the medium from an input location through the print zone 14. In some embodiments, the medium may comprise paper or another suitable medium on which an image may be formed by printing.

In one embodiment, the media transport 12 comprises a mechanism configured to pick an individual sheet of media from a stack of media and to supply the individual sheet to the print zone 14. The media transport 12 may also be configured to withdraw printed-upon media from the print zone 14 and to transport withdrawn media to an output tray, bin or the like (not shown).

A carriage 20 supports at least one pen 18. In FIG. 1, the carriage 20 is shown in two different positions. In one position, the carriage 20 is shown as being adjacent the print zone 14. In another position, the carriage 20 is shown as being adjacent service station 22. In operation, the carriage 20 moves between these positions and may also, in some embodiments, move to other positions. Each pen 18 comprises one or more printheads configured to dispense imaging material such as ink, upon the medium. In one embodiment, the printheads comprise piezo electric printheads. In another embodiment, the printheads comprise thermal inkjet printheads. In some embodiments, the carriage 20 supports multiple pens.

The carriage 20 comprises one or more structures configured to movably support one or more pens 18 along axis 26. Actuator 21 comprises one or more actuators configured to move carriage 20 and pen 18 in the directions indicated by arrow 32 so as to selectively position pen 18 opposite to the medium in the print zone 14 or opposite to service station 22 under control of the controller 25. In one embodiment, actuator 21 may comprise a motor configured to drive a toothed pulley in engagement with a toothed belt coupled to carriage 20. In another embodiment, actuator 21 may comprise other forms of a linear actuator. The carriage 20 may move along axis 26 while sliding on a carriage rod (not shown). Pursuant to some embodiments, the actuator 21 includes multiple motors for providing power to different device components, such as to the service station 22.

Service station 22 comprises a station located along or adjacent axis 26 such that carriage 20 may position the pen 18 opposite, or adjacent, to station 22. Station 22 includes one or more components configured to perform one or more servicing operations upon one or more of the pens 18. As shown by FIG. 1, service station 22 includes one or more wiping elements 34 mounted on a sled 36. In some embodiments, the service station 22 may also include spittoon components (not shown), capping components (not shown), or both.

The actuator 21 is configured to move the sled 36 in directions 42 along axis 46 under control of the controller 25. As the sled 36 moves in the directions 42, the wiping element 34 also moves in the directions 42. In some embodiments, the wiping element 34 wipes the pen 18. The wiping of the pen 18 may at least partially remove ink, cellulose fibers, or other debris disposed on a nozzle plate 50 (FIGS. 2-6) from one or more of the nozzles 52 (FIGS. 3-6).

In some embodiments, the actuator 21 includes separate motors for driving the service station 22 and the carriage 20. In other embodiments, a single motor drives both the service station 22 and the carriage 20. In other embodiments, a single motor drives the media transport and the service station 22.

Pursuant to some example embodiments, the carriage 20 moves in the directions 32 while the sled 36, and thus the wiping element 34, moves in the directions 42 with the wiping element 34 in contact with the pen 18. In these embodiments, the carriage 20 may oscillate in the axis 26 while the wiping element 34 is in contact with the pen 18 and the sled 36 moves along the axis 46.

Moving the pen 18 back and forth along the axis 26 while moving the wiping element 34 along the axis 46 may result in the wiping element wiping the nozzle plate 50 along a path that is not aligned with a column of nozzles (FIGS. 3-6) on the plate. In some embodiments, this path may be substantially sinusoidal. In some embodiments, this path may have curved sections. In some embodiments, this path may cross the column of nozzles one or more times. By wiping the nozzle plate in this manner, debris removed from one nozzle may be less likely to be deposited in or on another nozzle in the same column by the wiping action.

Figure 2:
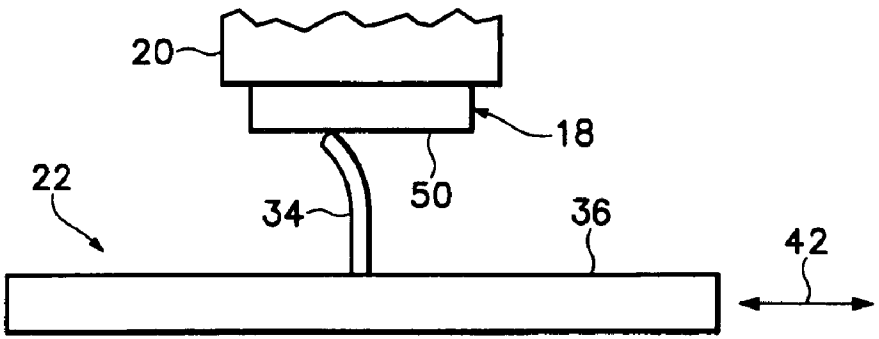
FIG. 2 illustrates an example wiping element according to an example embodiment.

FIG. 2 illustrates the wiping element 34 in contact with a nozzle plate 50 of the pen 18. The wiping element 34 is shown as being mounted on the sled 36, which forms a part of service station 22. While the sled 36 moves in the directions 42, the pen 18 moves in orthogonal directions. In FIG. 2, these orthogonal directions are into and out of the page. In some embodiments, these orthogonal directions are the directions 32 shown in FIG. 1.

Figure 3:
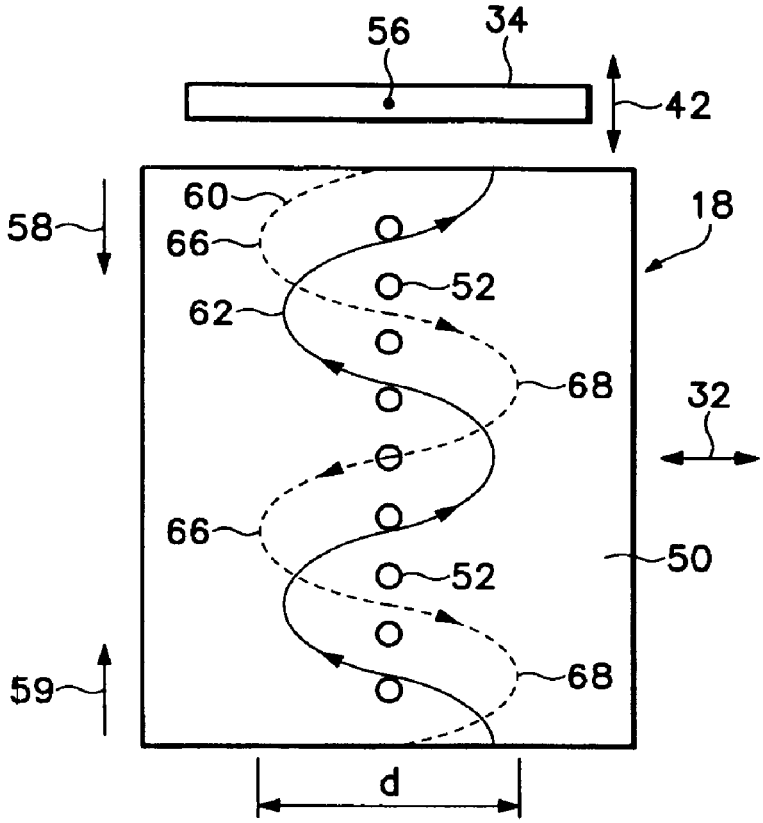
FIG. 3 illustrates an example path according to an example embodiment.

FIG. 3 illustrates example paths 60, 62 of contact between the wiping element 34 and the nozzle plate 50 of pen 18. For ease of explanation, the wiping element 34 is shown as including a reference point 56. During the wiping operation, the wiping element 34 begins by moving in direction 58 and contacts the nozzle plate 50. The nozzle plate 50 oscillates in,directions 32 while the wiping element moves in the direction 58. The combined movements of the nozzle plate 50 in the directions 32 and of the wiping element 34 in the direction 58 may result the reference point 56 of the wiping element 34 contacting or wiping the nozzle plate 50 along the path 60. Of course, other portions of the wiping element 34 also contact and wipe the nozzle plate 50 of a printhead. As illustrated, the path 60 crosses the column of nozzles 52 multiple times. In addition, the path 60 is shown as being substantially sinusoidal.

The path 60 includes a succession of waves or curves. In some embodiments, the path 60 comprises a series of peaks 66 and valleys 68, the peaks 66 and valleys 68 being disposed on opposite sides of the column of nozzles 52. In some example embodiments, the distance d between the peaks 66 and the valleys 68 is about 5 mm. This, of course, is an example dimension. Other values for the distance d may be alternatively employed. In some embodiments, the distance d is about the distance through which the pen oscillates during wiping.

As shown, the path 60 intersects the column of nozzles at an acute angle; that is, an angle greater than 0 degrees and smaller than 90 degrees. The path 60 may intersect the column of nozzles at an angle in the range of 15 to 75 degrees, inclusive of 15 and 75 degrees. Moreover, the substantially sinusoidal path 60 may have a constant frequency or a varying frequency. Additionally, the substantially sinusoidal path 60 may have a constant frequency or a varying phase.

The wiping element 34, in some embodiments, may wipe the nozzle plate 50 along path 62 as the wiping element moves in direction 59 and the nozzle plate 50 oscillates in directions 32. The direction 59 is opposite the direction 58. The path 62, as shown, may comprise a substantially sinusoidal path that is different from the path 62. The path 62 may have a different frequency, phase, or both compared to the path 60. Wiping the nozzle plate 50 along different paths may provide satisfactory cleaning of the nozzle plate 50 in some applications. The path 62 may also have a different shape than the path 60.

Figure 4:
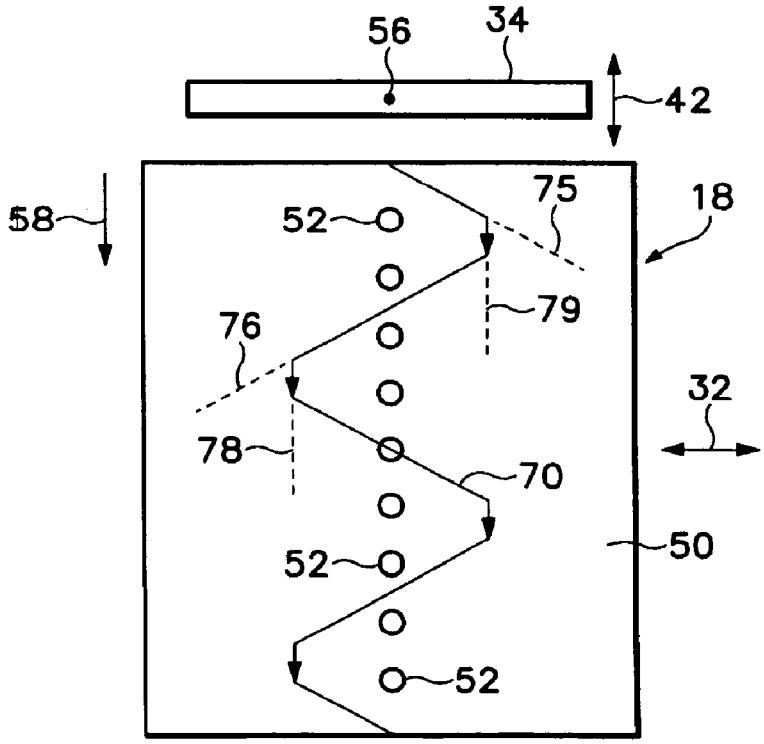
FIG. 4 illustrates an example path according to an example embodiment.

FIG. 4 illustrates example path 70. The path 70 is the path traversed by the reference point 56 as the wiping element 34 moves in direction 58 while the nozzle plate 50 moves, or oscillates, in directions 32. In this embodiment, the path 70 includes a series of substantially straight line segments, yet is substantially sinusoidal; the path 70 crosses the column of nozzles 52 at acute angles. In some embodiments, the path 70 crosses the column of nozzles 52 at angles in the range of 15 to 75 degrees, inclusive of 15 and 75 degrees. In this example, wiping occurs along several different axes, including axes 75, 76, 78, 79. The axes 78 and 79 are substantially parallel to each other, the column of nozzles 52, the direction 58. The axes 75 and 76 are not parallel with the column of nozzles 52 and are not parallel to each other. In some embodiments, the axes 75, 75 are substantially perpendicular to each other.

Figure 5:
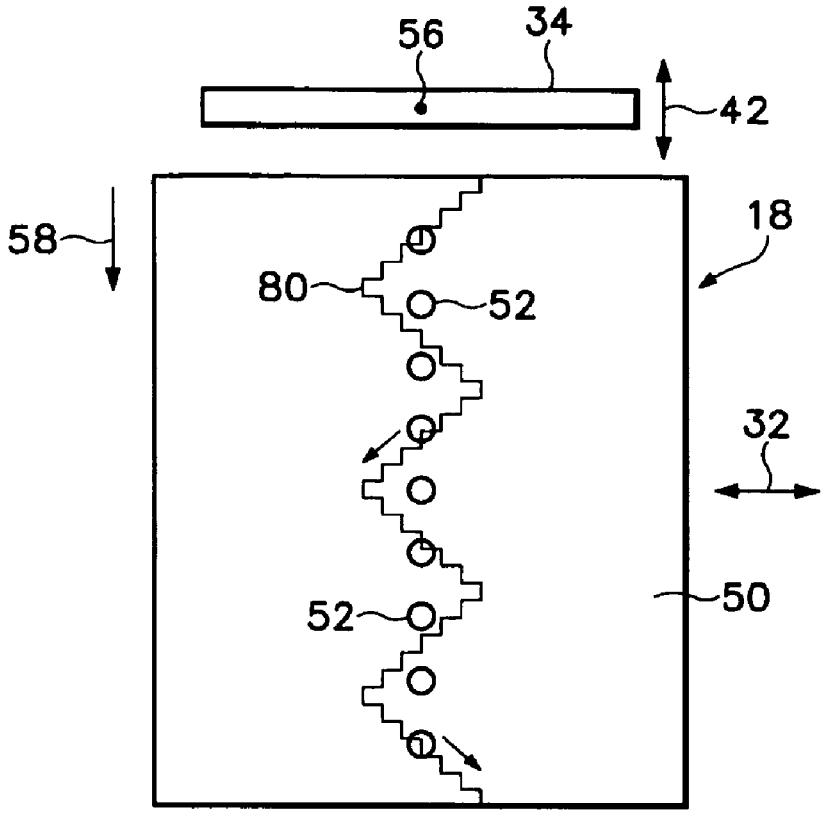
FIG. 5 illustrates an example path according to an example embodiment.

FIG. 5 illustrates example path 80. The path 80 crosses the column of nozzles 52 multiple times as the wiping element 34 moves in the direction 58 and the nozzle plate 50 oscillates in the directions 32. In this embodiment, however, the wiping element 34 moves in the direction 58 when the nozzle plate 50 is stopped. The nozzle plate 50 moves in one of the directions 32 when the wiping element is stopped. In this manner, the reference point 56 of wiping element 34 may move in a substantially sinusoidal path by moving one of the wiping element 34 and pen 18 at a time. This embodiment may be employed, for example, in configurations in which a single motor drives both the carriage 20 and the service station 22.

Figure 6:
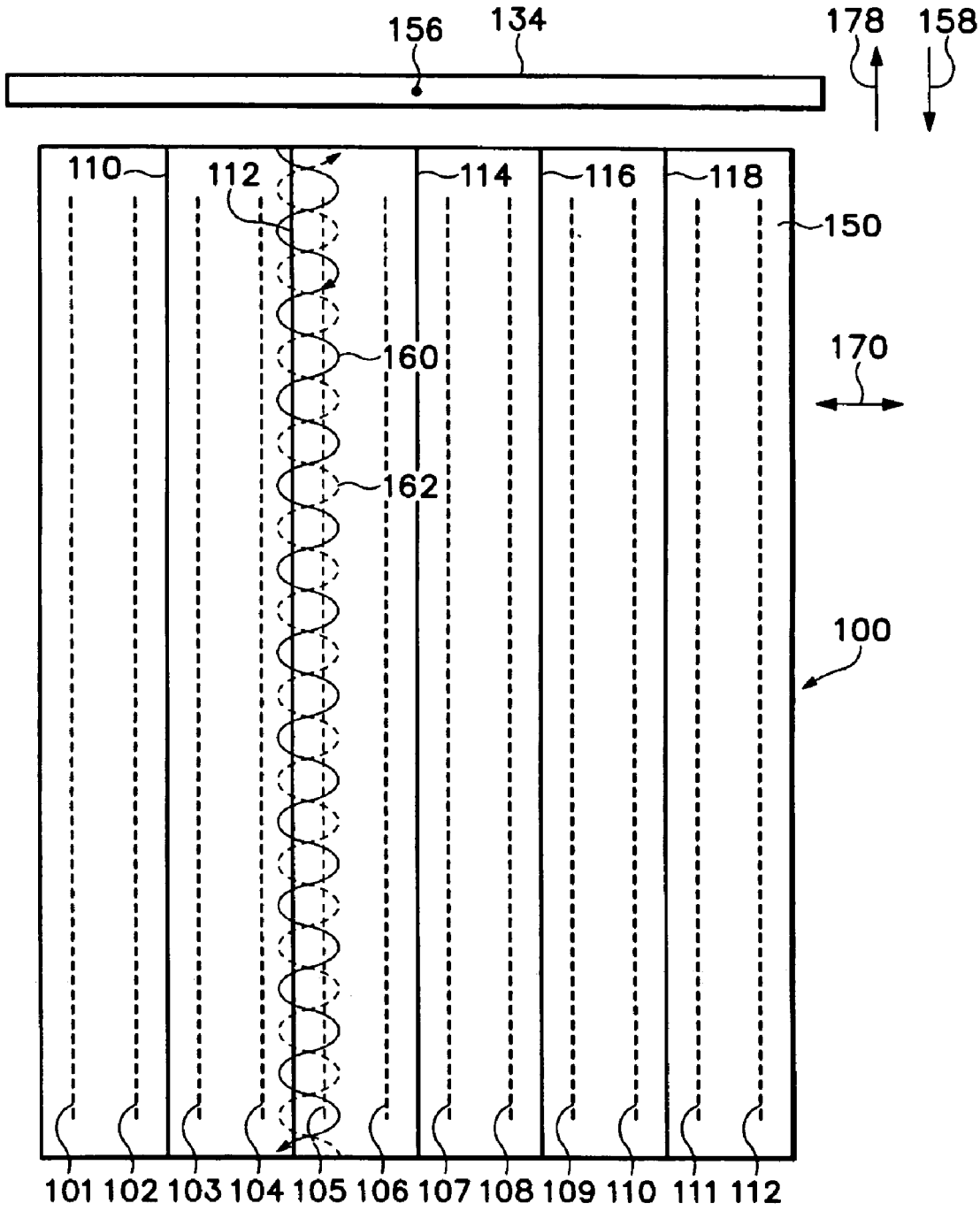
FIG. 6 illustrates an example path according to an example embodiment.

FIG. 6 illustrates an example pen 100, which may be used in the place of pen 18 (FIG. 1). The pen 100 is shown as having twelve nozzle columns 101, 102, 103, 104, 105, 106, 107, 108, 109, 110, 111, 112. The nozzle columns 101-112 are arranged such that they are substantially parallel with each other. The nozzle columns are also arranged in pairs. The nozzle column pairs illustrated in FIG. 6 are as follows: 101, 102 and 103, 104, and 105, 106 and 107, 108 and 109, 110, and 111, 112. Different nozzle column pairs, in some embodiments, dispense ink of a different color or type than the ink dispensed by the adjacent nozzle column pairs.

Adjacent pairs of nozzle columns 101-112 are separated by elongated channels. Channel 110 is disposed between nozzle column pairs 101, 102 and 103, 104. Channel 112 is disposed between nozzle column pairs 103, 104, and 105, 106. Channel 114 is disposed between nozzle column pairs 105, 106 and 107, 108. Channel 116 is disposed between nozzle column pairs 107, 108 and 109, 110. Channel 118 is disposed between nozzle-column pairs 109, 110, and 111, 112. The channels 110-118 shown in FIG. 6 are substantially parallel with each other and with the nozzle columns 101-112.

The channels 110-118 are elongated recesses formed in nozzle plate 150. Pursuant to embodiments in which adjacent nozzle column pairs eject ink of different colors or types, the channels 110-118 may be used to reduce cross-contamination. In particular, the channels 110-118 may limit, reduce, or substantially prevent ink of a first type disposed on the nozzle plate 150 between adjacent channels from crossing a channel and potentially contaminating nozzles on the other side of the channel. Pursuant to some embodiments, ink that enters a channel is advanced via wicking or capillary action to a suitable location away from the nozzles.

Wiping paths 160, 162 illustrate a path of contact between a reference point 156 of a wiping element 134 and the nozzle plate 150 of pen 100. The reference point 156 moves along the path 160 as the wiping element 134 moves in direction 158 and the pen 100 oscillates in directions 170. As shown, the path 160 crosses the nozzle column 105 and the channel 112. Consequently, in some applications, ink or other debris wiped by the wiping element 134 may be deposited by the wiping element 134 into the channel 112 as the wiping element 134 crosses the channel 112. The reference point 156 moves along the path 162 as the wiping element 134 moves in the direction 178 and the pen oscillates in directions 170.

In some embodiments, one or more of the paths 160, 162 cross multiple nozzle columns. Also, in some embodiments, one or more of the paths 160, 162 cross multiple channels.

The paths 160, 162 may have different phases, different frequencies, or both. Further, as shown in FIG. 6, the paths 160, 162 are distinct from each other. In some embodiments, however, the paths 160, 162 may be the same.

Figure 7:
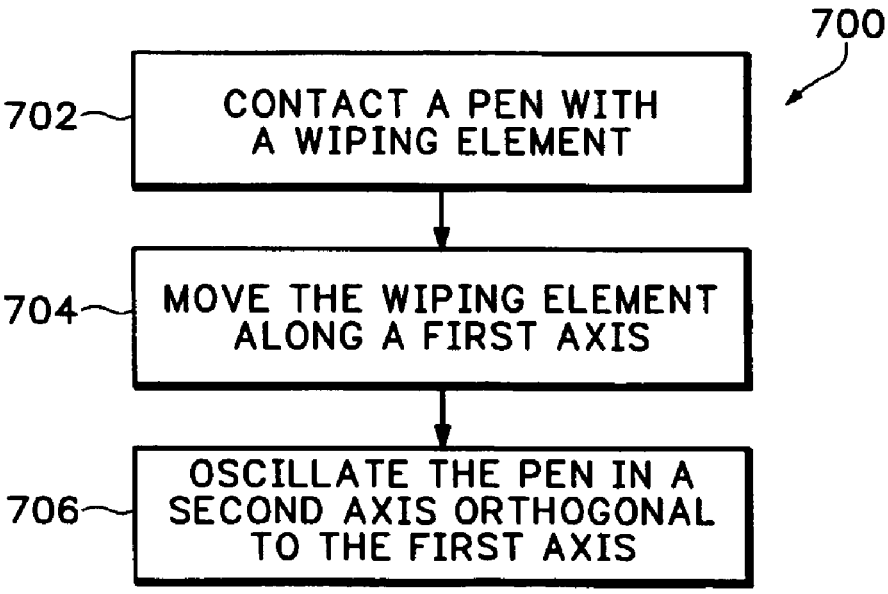
FIG. 7 illustrates an example flow chart according to an example embodiment.

FIG. 7 is a flowchart illustrating an example method 700. At block 702, a pen, such as the pen 18 or the pen 100, is contacted by a wiping element, such as the wiping element 34 or the wiping element 134. At block 704, the wiping element moves along a first axis. At block 706, the pen oscillates in a second axis, where the second axis is orthogonal to the first axis. In some embodiments, the pen and the wiping element maintain contact with each other during blocks 704 and 706.

The present disclosure has been described with reference to example embodiments, however workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A device, comprising:

a wiper; and a printhead configured to move along an axis while the wiper moves perpendicular to the axis.

2. The device of claim 1, wherein the printhead further comprises a column of nozzles substantially perpendicular to the axis, wherein different portions of the wiper contact the column of nozzles as the wiper moves perpendicular to the axis.

3. The device of claim 1, further comprising:

a first channel formed in the printhead;

a second channel formed in the printhead;

one or more columns of nozzles disposed between first and second recesses formed in the printhead, the one or more columns of nozzles being substantially parallel;

wherein different portions of the wiper contact the first channel as the wiper moves perpendicular to the axis.

4. The device of claim 1, wherein the printhead is further configured to oscillate along the axis while the wiper contacts the printhead.

5. The device of claim 1, wherein the wiper contacts the printhead along a first path as the wiper moves in a first wiping direction perpendicular to the axis and the wiper contacts the printhead along a second different path as the wiper moves in a second wiping direction perpendicular to the axis, the second wiping direction opposite the first wiping direction.

6. The device of claim 1, wherein the wiper contacts the printhead along a substantially sinusoidal path.

7. The device of claim, 1 wherein the wiper contacts the printhead along a curved path.

8. The device of claim 1, wherein the wiper contacts the printhead along a non-linear path.

9. A method, comprising:

wiping a pen along a first axis;

wiping the pen along a second axis, the second axis being different from the first axis, wherein the pen includes a column of nozzles and at least one of the first and second axes crosses the column of nozzles.

10. The method of claim 9, wherein the wiping of the pen along a first axis is performed by a wiping element, further comprising maintaining contact between the wiping element and the pen during:

the wiping of the pen along a first axis;

the wiping of the pen along the second axis.

11. The method of claim 9, wherein the pen includes a channel and at least one of the first and second axes crosses the column of nozzles and the channel.

12. A method, comprising:

contacting a pen with an element;

moving the element across the pen along a substantially sinusoidal path.

13. The method of claim 12, wherein a reference point on the element crosses a column of nozzles during the moving the element across the pen along the substantially sinusoidal path.

14. The method of claim 12, wherein a reference point on the element crosses a channel formed in the pen during the moving the element across the nozzle plate along the substantially sinusoidal path.

15. A method, comprising:

wiping a printhead along a first non-linear path with a wiper;

wiping the printhead along a second non-linear path with the wiper, the second path being different from the first path.

16. The method of claim 15, wherein the first path is a substantially sinusoidal path.

17. The method of claim 15, wherein the first path includes a succession of curves.

18. The method of claim 15, wherein contact between the printhead and the wiper is maintained during the wiping the printhead along the first path and the wiping the printhead along the second path.

19. The method of claim 15, wherein the first path crosses a recess formed in the printhead.

* * * * *

UNITED STATES PATENT AND TRADEMARK OFFICE

CERTIFICATE OF CORRECTION

PATENT NO. : 7,448,726 B2
APPLICATION NO. : 11/252691
DATED : November 11, 2008
INVENTOR(S) : Kit L Harper et al.

It is certified that error appears in the above-identified patent and that said Letters Patent is hereby corrected as shown below:

In column 5, line 30, in Claim 7, delete ‘‘claim, 1” and insert -- claim 1, --, therefor.

Signed and Sealed this

Thirty-first Day of March, 2009

JOHN DOLL
*Acting Director of the United States Patent and Trademark Office*